US011207912B2

(12) United States Patent
McGraw

(10) Patent No.: US 11,207,912 B2
(45) Date of Patent: Dec. 28, 2021

(54) WRITING UTENSIL SAFETY SHEATH

(71) Applicant: Michael W. McGraw, Hoover, AL (US)

(72) Inventor: Michael W. McGraw, Hoover, AL (US)

( * ) Notice: Subject to any disclaimer, the term of this patent is extended or adjusted under 35 U.S.C. 154(b) by 232 days.

(21) Appl. No.: 16/687,047

(22) Filed: Nov. 18, 2019

(65) Prior Publication Data

US 2020/0156401 A1 May 21, 2020

Related U.S. Application Data

(60) Provisional application No. 62/770,501, filed on Nov. 21, 2018.

(51) Int. Cl.
*B43K 23/08* (2006.01)
*B43K 23/008* (2006.01)

(52) U.S. Cl.
CPC ..... *B43K 23/08* (2013.01); *B43K 23/008* (2013.01)

(58) Field of Classification Search
CPC ..... B43K 23/00; B43K 23/008; B43K 23/08; B43K 23/10; B43K 23/12; B43K 23/128
See application file for complete search history.

(56) References Cited

U.S. PATENT DOCUMENTS 368,517 * 8/1887 Cornwall ..... A45D 40/0081 401/88
837,911 * 12/1906 Benson ..... B43K 23/10 401/91
895,511 * 8/1908 Sturgis ..... B43K 23/10 401/91
971,797 * 10/1910 Smythe ..... B43K 23/10 401/91
1,392,468 * 10/1921 Watkins ..... B43K 23/10 401/91
1,452,013 * 4/1923 Williams ..... B43K 23/10 30/460
1,470,724 * 10/1923 Ginsberg ..... B43K 23/10 401/91
1,598,873 * 9/1926 Peterson ..... B43K 23/004 401/6
1,647,536 * 11/1927 Miller ..... B43K 23/00 401/88
3,740,159 * 6/1973 Smagala-Romanoff ..... B43K 7/12 401/117
4,595,307 * 6/1986 Heyden ..... B43K 23/10 401/117

(Continued)

*Primary Examiner* — Patrick M. Buechner
(74) *Attorney, Agent, or Firm* — Burr & Forman LLP; Patrick A. Reid

(57) ABSTRACT

A writing utensil safety sheath comprising a body having a first open end and an internal channel. The internal channel is sized to retain at least a portion of a writing utensil in either a first extended position or a retracted position. The writing utensil safety sheath also has a grip affixed to and extending beyond the first open end of the body. The grip contacts a writing end of the writing utensil when the writing utensil is in the first extended position thus retaining the writing utensil in the first extended position while writing. When a force applied to the writing end exceeds a predetermined amount, the writing utensil retracts back into the body by sliding through the grip into the first open end of the body.

17 Claims, 5 Drawing Sheets

(56) References Cited

U.S. PATENT DOCUMENTS

| | | | | |
|---|---|---|---|---|
| 4,911,570 | * | 3/1990 | Rhoades | A45D 34/042<br>401/107 |
| 6,276,854 | * | 8/2001 | Mullins | B43K 23/016<br>401/131 |
| 6,779,937 | * | 8/2004 | Lombardi | B43K 23/10<br>401/247 |
| D672,392 | * | 12/2012 | Santos | B43K 23/10<br>D19/179 |
| 2006/0029460 | * | 2/2006 | Russo | B43K 23/10<br>401/247 |

* cited by examiner

WRITING UTENSIL SAFETY SHEATH

CROSS-REFERENCE TO RELATED APPLICATION

This application claims the benefit of Provisional Patent Application No. 62/770,501, filed on Nov. 21, 2018, the contents of which are hereby incorporated by reference.

FIELD

The present disclosure relates to the field of school and office supply safety, and more particularly to a writing utensil sheath that prevents harm that may be caused by accidental exposure to the writing utensil point.

BACKGROUND

The writing end of a pen or pencil is hazardous and can cause injury to person or property. During use, the exposed writing end presents a stabbing hazard. If the writing end becomes exposed when a writing utensil is in a bag or pocket, the writing end can stick or snag during transport. The problem of accidentally snagging or stabbing is solved by a writing utensil sheath.

SUMMARY

The Writing Utensil Safety Sheath securely stores a writing utensil in a retracted position for storage or transport. Then, a user may extend the writing end or an opposite end out of an open end of the Sheath for use. However, when a force more than a predetermined force is applied to an extended writing end, the writing end will slide back into the Sheath without harm to the object that applied the force.

In one embodiment, the writing utensil safety sheath has a body having a first open end and an internal channel. The internal channel is sized to retain at least a portion of a writing utensil in both a first extended position and a retracted position. The sheath also has a grip affixed to and extending beyond the first open end of the body. The grip contacts a writing end of the writing utensil when the writing utensil is in the first extended position thus retaining the writing utensil in the first extended position while writing. The grip allows the writing end of the writing utensil to retract back within the first open end of the body when a force applied to the writing end exceeds a predetermined amount.

In another embodiment, the writing utensil safety sheath has a slot on the body exposing at least a portion of the writing utensil within the internal channel. The slot allows a user to manipulate the writing utensil within the body.

In another embodiment, the writing utensil safety has an O-ring affixed around the body. The O-ring applies compressive force to the body thus further retaining the writing utensil within the body.

In another embodiment, the writing utensil safety sheath has a notch in the body to receive the O-ring thus allowing the O-ring to contact the writing utensil and apply additional compressive force.

In another embodiment, the writing utensil safety sheath has a second open end and a second grip. The second grip is affixed to and extends beyond the second open end of the body. The second grip contacts an opposite end of the writing utensil when the writing utensil is in a second extended position thus retaining the writing utensil in the second extended position during use.

In another embodiment, the internal channel is sized to retain both the writing end and an opposite end of the writing utensil in the retracted position.

In yet another embodiment, a writing utensil safety sheath includes a body having a first open end and an internal channel. The internal channel is sized to retain at least a portion of a writing utensil in both a first extended position and a retracted position. The writing utensil safety sheath also includes an O-ring affixed to the body and applying a compressive force on the body to secure the writing utensil in either the first extended position or the retracted position. The O-ring allows a writing end of the writing utensil to retract back within the first open end of the body when a force applied to the writing end exceeds a predetermined amount.

DETAILED DESCRIPTION

Figure 1:
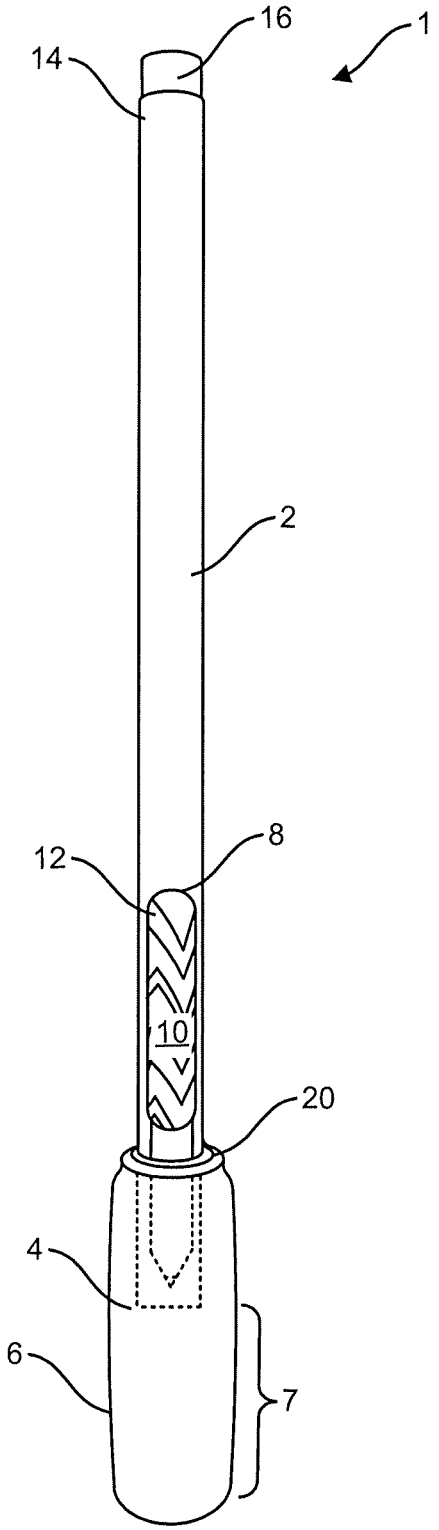
FIG. 1 illustrates a first embodiment of the Writing Utensil Safety Sheath of the present disclosure with a writing utensil in a retracted position.

Referring to FIG. 1, one exemplary embodiment of the Writing Utensil Safety Sheath 1 of the present disclosure is shown. The Sheath 1 is comprised of a body 2, a first open end 4, a grip 6, and where body 2 includes a slot 8. The grip 6 is affixed (either permanently or removably) to the body 2 on the first open end 4, and a portion 7 of the grip 6 extends out beyond the first open end 4 of the body 2. The body 2 has an internal channel 12, which is partially revealed by slot 8. The Sheath 1 is configured to receive a writing utensil 10 through the first open end 4 and within the channel 12. The channel 12 is sized to retain the writing utensil 10 within the body 2. The writing utensil 10 is slidably retained within the channel 12.

In some embodiments of the Sheath 1, a second end 14 is closed or includes an eraser 16. The eraser 16 may be interchangeable or replaceable. In other embodiments, second end 14 could also be open.

In a retracted position, the writing utensil may be completely concealed within the body 2, as shown in FIG. 1, thus shielding the point of the writing utensil 10. In one exemplary embodiment of the Writing Utensil Safety Sheath 1, the body 2 may be approximately 7.5 inches in length. However, the Writing Utensil Safety Sheath 1 could be made to any length and adapted to be used with writing utensils of various lengths and diameters.

In one exemplary embodiment of the Writing Utensil Safety Sheath 1, the diameter of the internal channel 12 is sized to accommodate the writing utensil 10 such that the utensil 10 cannot slide freely without some force applied by a user. By way of example, to accommodate a standard pencil, the internal channel 12 may have a diameter of $^{21}/_{64}$ inches.

In one exemplary embodiment of the Writing Utensil Safety Sheath 1, the body 2 may be made of a substantially rigid material strong enough to withstand normal use; for example, plastic, metal, wood, rubber, or other similar material.

In one exemplary embodiment, the grip 6 is malleable such that a user can squeeze, bend, or deform the grip 6. The grip 6 may be made of a foam, rubber, or any soft, plastic, gripping material.

The slot 8 is located on the body 2 and exposes the internal channel 12. When a writing utensil 10 is in the Sheath 1, a user can slide the writing utensil 10 within the channel 12 by directly contacting and pushing or manipulating the writing utensil 10 via the slot 8.

In one exemplary embodiment (not shown), the Writing Utensil Safety Sheath 1 includes two or more slots 8. One slot 8 is centered on the body 2 with a length of about 2⅜ inches and, for example, a second, smaller slot 8 located closer to the second end 14. In one non-limiting embodiment, the slot 8 may have a width of about 0.25 inches.

Figure 2:
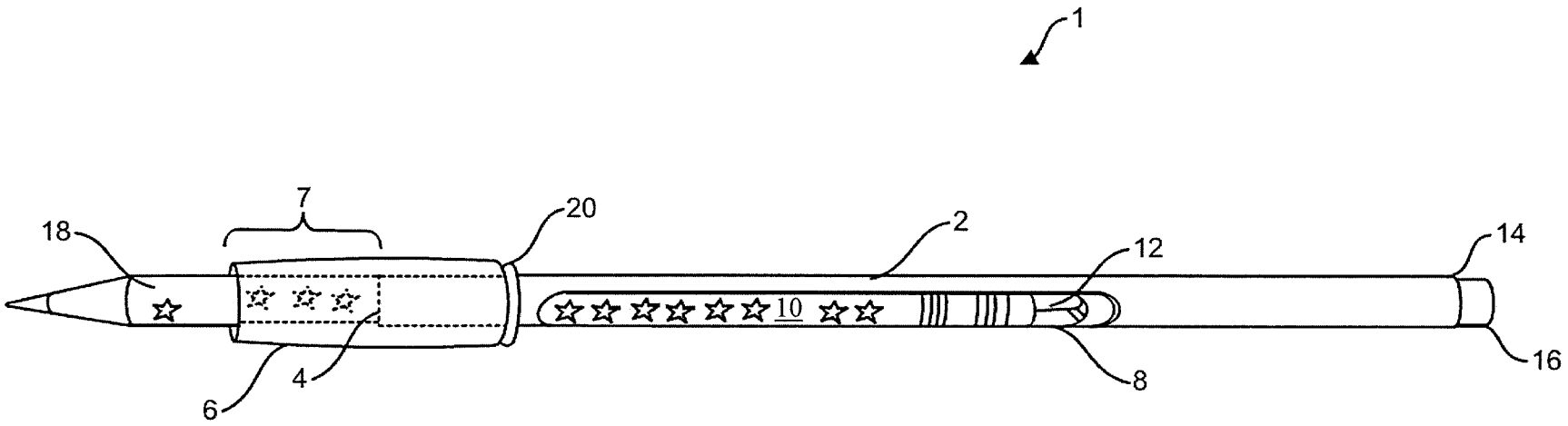
FIG. 2 illustrates the writing utensil in a first extended position.

Referring to FIG. 2, a first extended position of the writing utensil within the Sheath 1 is shown. A writing end 18 of the utensil 10 extends out of the first open end 4 and through the portion 7 of the grip 6 that continues beyond the first open end 4. Inside the portion 7 of the grip 6 that extends beyond the first open end 4, the grip 6 contacts the writing utensil 10 near the writing end 18. Thus, the grip 6 is configured to maintain the writing utensil 10 in the first extended position when a user holds the grip 6 to write.

The writing utensil 10 is retained through a combination of compressive force which is applied by the grip 6 having an internal diameter sized to hold the writing utensil 10. Friction is also applied by the grip 6 directly contacting the writing utensil 10. By varying material or internal diameter of the grip 6, the grip 6 can be configured to resist a range forces applied to the writing end 18 from 0.5 N and up. In one non-limiting embodiment, the predetermined force may be 1.5 N. Thus, the grip 6 may be sized to compress the writing utensil 10 and resist sliding back into the body 2 until a force greater than 1.5 N is applied to the writing end 18, for example, during a fall or stabbing motion, the writing end 18 of the utensil 10 will slide back into the body 2 of the Sheath 1.

In some embodiments of the Sheath 1, the grip 6 may be configured to prevent the writing utensil 10 from sliding out of the open end 4 unless a force is applied by a user to the writing utensil 10 via the slot 8. In some embodiments, the required force to be applied by the user is as little as 0.01 N.

In some embodiments, the Writing Utensil Safety Sheath 1 includes an O-ring 20 or other similar type of gasket. The O-ring 20 is configured to maintain the writing utensil 10 in either the extended position or the retracted position by applying compression to the writing utensil 10. In one exemplary embodiment, when the O-ring 12 is affixed to the body 2, the O-ring 20 applies a compressive force to the body 2. The compressive force is then transferred through the body 2 and acts on the writing utensil 10 within the channel 12.

In some embodiments, there is at least one notch 22 (shown in FIG. 3) in the body 2. The O-ring 20 may be affixed to the body 2 at the notch 22 such that the O-ring 20 applies compressive force to the body 2 as well as friction to the writing utensil 10 by direct contact with the writing utensil 10 through the notch 22.

In one non-limiting embodiment, an O-ring 20 may be located approximately 1 5/16 inches from the first end 4. The O-ring 20 may be affixed to the body and seated in a notch 22 (or slit or hole) in the body 2. Thus, the O-ring 20 provides the compressive force around the body 2 as well as friction directly to the writing utensil 10 through the notch 22.

Figure 3:
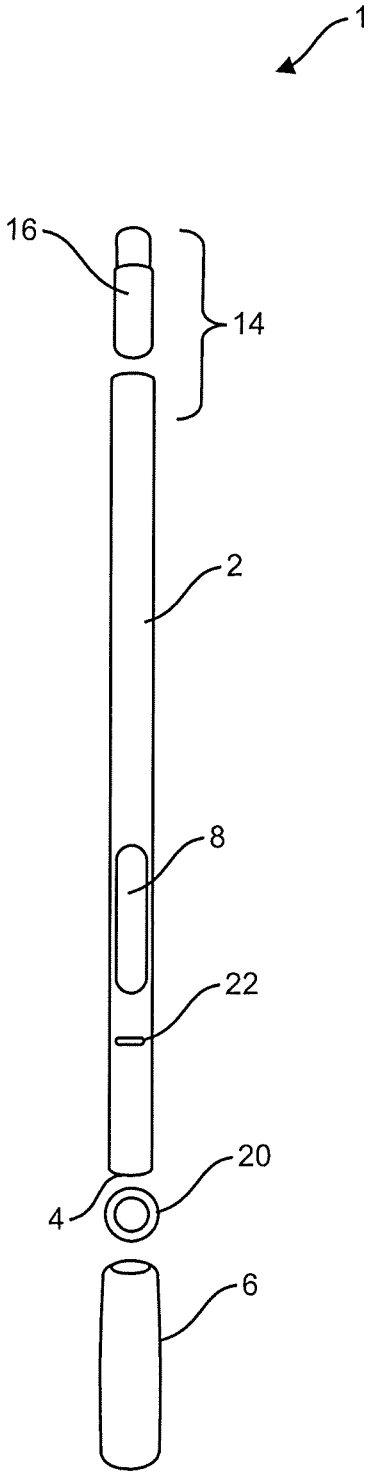
FIG. 3 illustrates an exploded view of the first embodiment of the Sheath showing the separate parts.

Referring to FIG. 3, an exploded view of the first embodiment of the Sheath 1 is shown. In this view, the slot 8 is located near the first open end 4 and the notch 22 is located between the first open end 4 and the slot 8. However, the notch 22 may be located anywhere along the body 2. Optionally, the O-ring 20 may be placed over the slot 8 and no notch 22 is necessary.

Figure 4:
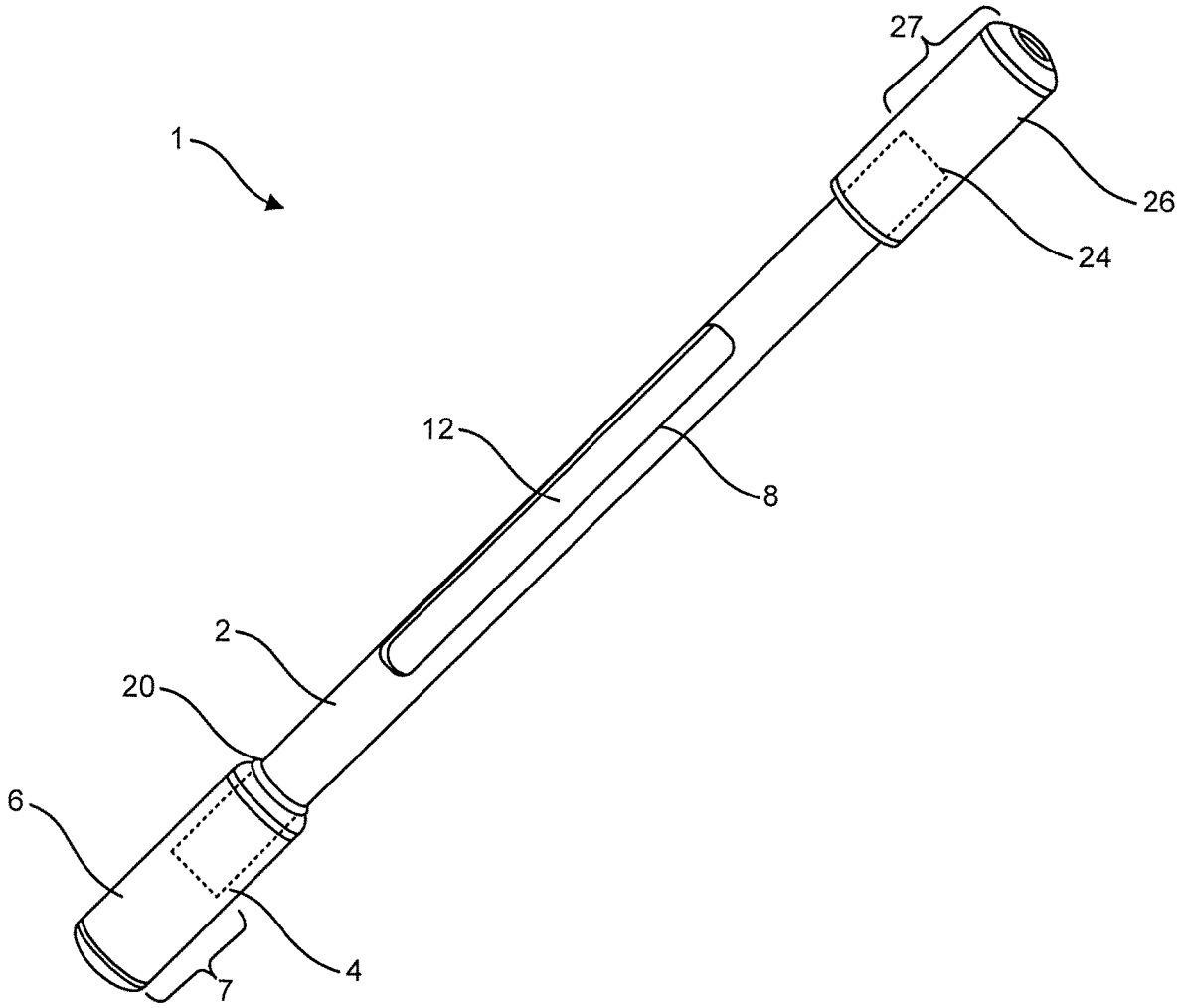
FIG. 4 illustrates another embodiment of the Writing Utensil Safety Sheath having a second open end.

Referring to FIG. 4, another embodiment of the Writing Utensil Safety Sheath 1 is shown having a second open end 24. The second open end 24 may include a second grip 26.

Figure 5:
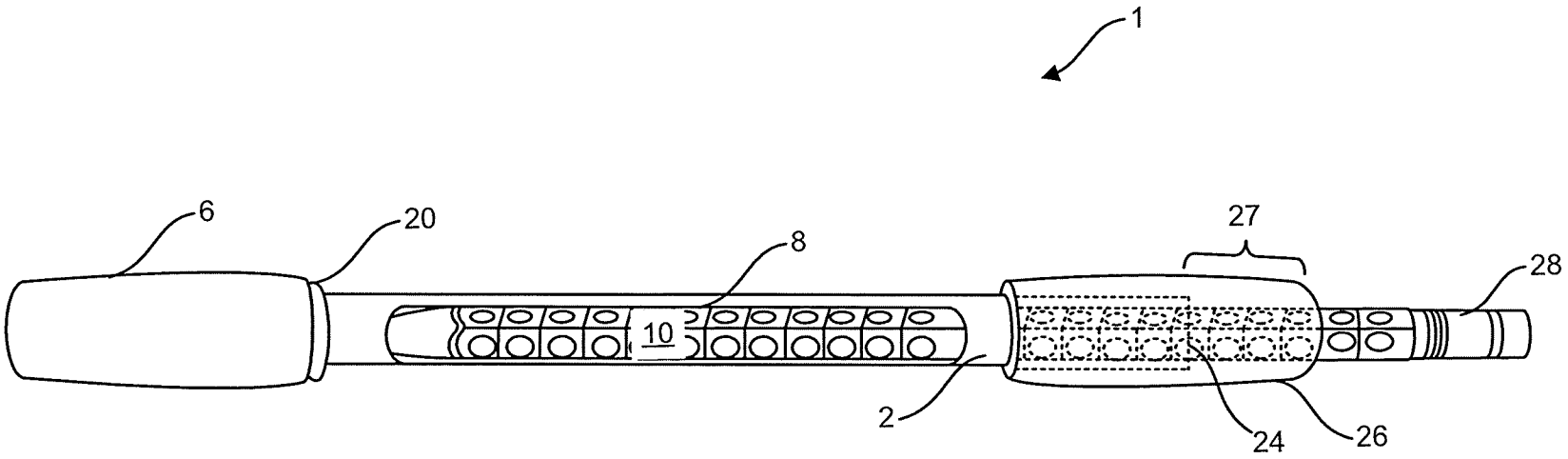
FIG. 5 illustrates the writing utensil in a second extended position.

Referring to FIG. 5, a second extended position of the writing utensil 10 within the Sheath 1 is shown. The second grip 26 is affixed to the body 2 on the second open end 24, and a portion 27 of the second grip 26 extends out beyond the second open end 24 of the body 2. An opposite end 28 of the utensil 10 extends out of the second open end 24 and through the portion 27 of the second grip 26 that continues beyond the second open end 24. Inside the portion 27 of the second grip 26 that extends beyond the second open end 24, the second grip 26 contacts the writing utensil 10 near the opposite end 28. Thus, the second grip 26 is configured to maintain the writing utensil 10 is in the second extended position when a user holds the second grip 26 to erase.

The second grip 26 may be configured to prevent the writing utensil 10 from sliding out unless a force is applied by a user to the writing utensil 10 via the slot 8. In these embodiments, the second grip 26 is also configured to allow the opposite end 28 to slide back into the second open end 24 when a force greater than a predetermined amount is applied to the opposite end 28.

Many different embodiments have been disclosed herein, in connection with the above description and the drawings. It will be understood that it would be unduly repetitious and obfuscating to literally describe and illustrate every combination and subcombination of these embodiments. Accordingly, all embodiments can be combined in any way and/or combination, and the present specification, including the drawings, shall be construed to constitute a complete written description of all combinations and subcombinations of the embodiments described herein, and of the manner and process of making and using them, and shall support claims to any such combination or subcombination.

It will be appreciated by persons skilled in the art that the embodiments described herein are not limited to what has been particularly shown and described herein above. In addition, unless mention was made above to the contrary, it should be noted that all of the accompanying drawings are not to scale. A variety of modifications and variations are possible in light of the above teachings.

What is claimed is:

1. A writing utensil safety sheath comprising:

a body having a first open end and an internal channel, the internal channel sized to retain at least a portion of a writing utensil in both a first extended position and a retracted position; and a grip affixed to and extending beyond the first open end of the body, the grip configured to contact a writing end of the writing utensil when the writing utensil is in the first extended position thus retaining the writing utensil in the first extended position during use, the grip further configured to allow the writing end of the writing utensil to retract back within the first open end of the body when a force applied to the writing end exceeds a predetermined amount.

2. The writing utensil safety sheath of claim 1, further comprising a slot on the body exposing at least a portion of the writing utensil within the internal channel, the slot configured to allow a user to manipulate the writing utensil within the body.

3. The writing utensil safety sheath of claim 1, further comprising an O-ring, the O-ring affixed around the body, the O-ring applying compressive force to the body thus further retaining the writing utensil within the body.

4. The writing utensil safety sheath of claim 3, further comprising a notch in the body, the notch configured to receive the O-ring thus allowing the O-ring to contact the writing utensil and apply additional compressive force.

5. The writing utensil safety sheath of claim 1, further comprising:

a second open end and a second grip, the second grip affixed to and extending beyond the second open end of the body, the second grip configured to contact an opposite end of the writing utensil when the writing utensil is in a second extended position thus retaining the writing utensil in the second extended position during use.

6. The writing utensil safety sheath of claim 1, wherein the internal channel is sized to retain both the writing end and an opposite end of the writing utensil in the retracted position.

7. A writing utensil safety sheath comprising:

a body having a first open end and an internal channel, the internal channel sized to retain at least a portion of a writing utensil in both a first extended position and a retracted position; and an O-ring affixed to the body, the O-ring configured to apply a compressive force on the body, and to secure the writing utensil in either the first extended position or the retracted position, the O-ring further configured to allow a writing end of the writing utensil to retract back within the first open end of the body when a force applied to the writing end exceeds a predetermined amount.

8. The writing utensil safety sheath of claim 7, further comprising a notch on the body, the notch configured to receive the O-ring, thus allowing the O-ring to contact the writing utensil through the notch and apply compressive force to retain the writing utensil in either the first extended position or the retracted position.

9. The writing utensil safety sheath of claim 7, further comprising a slot on the body exposing at least a portion of the writing utensil within the internal channel, the slot configured to allow a user to manipulate the writing utensil within the internal channel.

10. The safety sheath of claim 7, further comprising a grip affixed to and extending beyond the first end of the body, the grip configured to contact the writing end of the writing utensil when the writing utensil is in the first extended position thus retaining the writing utensil in the first extended position during use, the grip further configured to allow the writing end of the writing utensil to retract back within the first open end of the body when a force applied to the writing end exceeds the predetermined amount.

11. The writing utensil safety sheath of claim 10, further comprising a second open end and a second grip, the second grip affixed to and extending beyond the second open end of the body, the second grip configured to contact an opposite end of the writing utensil when the writing utensil is in a second extended position thus retaining the writing utensil in the second extended position during use.

12. The writing utensil safety sheath of claim 7, wherein the internal channel is sized to retain both the writing end and an opposite end of the writing utensil in the retracted position.

13. A writing utensil safety sheath comprising:

a body having a first open end and an internal channel, the internal channel sized to retain at least a portion of a writing utensil in both a first extended position and a retracted position;

a grip affixed to and extending beyond the first open end of the body, the grip configured to contact a writing end of the writing utensil when the writing utensil is in the first extended position thus retaining the writing utensil in the first extended position during use, the grip further configured to allow the writing end of the writing utensil to retract back within the first open end of the body when a force applied to the writing end exceeds a predetermined amount; and an O-ring affixed to the body, the O-ring configured to apply a compressive force on the body and to secure the writing utensil in either the first extended position or the retracted position, the O-ring further configured to allow the writing end of the writing utensil to retract back within the first open end of the body when a force applied to the writing end exceeds the predetermined amount.

14. The writing utensil safety sheath of claim 13, further comprising a notch on the body, the notch configured to receive the O-ring, thus allowing the O-ring to contact the writing utensil through the notch and apply compressive force to retain the writing utensil in either the first extended position or the retracted position.

15. The writing utensil safety sheath of claim 13, further comprising a slot on the body exposing at least a portion of the writing utensil within the internal channel, the slot configured to allow a user to move the writing utensil into the first extended position or the retracted position by contacting the writing utensil through the slot.

16. The writing utensil safety sheath of claim 13, further comprising a second open end and a second grip, the second grip affixed to and extending beyond the second open end of the body, the second grip configured to contact an opposite end of the writing utensil when the writing utensil is in a second extended position thus retaining the writing utensil in the second extended position during use.

17. The writing utensil safety sheath of claim 13, wherein the internal channel is sized to retain both the writing end and the opposite end of the writing utensil in the retracted position.

* * * * *